US008033191B2

(12) United States Patent
Nagahara et al.

(10) Patent No.: US 8,033,191 B2
(45) Date of Patent: Oct. 11, 2011

(54) STARTER

(75) Inventors: Ken Nagahara, Kiryu (JP); Shuji Uehara, Maebashi (JP); Kazuo Iwashita, Kiryu (JP); Kazuhiko Ono, Asaka (JP); Koji Suzuki, Kawagoe (JP)

(73) Assignees: Mitsuba Corporation, Kiryu-Shi (JP); Honda Giken Kogyo Kabushiki Kaisha, Tokyo (JP)

( * ) Notice: Subject to any disclaimer, the term of this patent is extended or adjusted under 35 U.S.C. 154(b) by 820 days.

(21) Appl. No.: 12/073,121

(22) Filed: Feb. 29, 2008

(65) Prior Publication Data

US 2008/0229879 A1 Sep. 25, 2008

(30) Foreign Application Priority Data

Mar. 22, 2007 (JP) ..... 2007-073875

(51) Int. Cl.
*F02N 15/02* (2006.01)

(52) U.S. Cl. ..... 74/7 E; 74/6

(58) Field of Classification Search ..... 74/7 E, 74/6, 7 R
See application file for complete search history.

(56) References Cited

U.S. PATENT DOCUMENTS 4,896,550 A * 1/1990 Hikichi et al. ..... 74/6
5,267,539 A * 12/1993 Becker et al. ..... 123/179.31

FOREIGN PATENT DOCUMENTS

JP U-63-164567 10/1988

* cited by examiner

*Primary Examiner* — William C Joyce
(74) *Attorney, Agent, or Firm* — Oliff & Berridge, PLC

(57) ABSTRACT

A starter that includes a motor portion that includes a motor shaft; a deceleration mechanism portion that is integrated with the motor portion, the deceleration mechanism portion includes a planetary gear that revolves around the motor shaft; and an output shaft that rotates integrally with a revolution of the planetary gear, wherein a bracket of the deceleration mechanism portion, in which a ring-shaped gear is formed at an inner circumferential surface so as to mesh with the planetary gear, is integrated with a casing of the motor portion by an intermediate bracket.

5 Claims, 2 Drawing Sheets

STARTER

CROSS-REFERENCE TO RELATED APPLICATION

This application claims priority from Japanese Patent Application No. 2007-73875, filed Mar. 22, 2007, the entire disclosure of which is incorporated herein by reference in its entirety.

BACKGROUND

The present disclosure relates to a starter.

There exists a starter that starts a engine of a two-wheeled motor vehicle. The starter is constructed by integrating a motor portion that is provided with a motor shaft into a deceleration mechanism portion that is provided with a planetary gear that revolves around the motor shaft and an output shaft that receives a revolution of the planetary gear.

In order to secure a necessary deceleration ratio, the deceleration mechanism of the starter is constructed so as to be provided with a first deceleration mechanism that is composed of a first planetary gear that revolves around the motor shaft and a first output shaft that rotates integrally with a revolution of the first planetary gear, and with a second deceleration mechanism that is composed of a second planetary gear that revolves around the first output shaft and a second output shaft that rotates integrally with a revolution of the second planetary gear. As a result, the second output shaft can rotate while receiving the two-staged deceleration (see Japanese Published Unexamined Utility Model Application No. S63-164567 for example).

SUMMARY

A first and a second bracket are integrated so as to function as ring gears of the first and second deceleration mechanisms. The first bracket is directly integrated with a casing (end bracket) of the motor portion. It has been demanded in recent years to increase the deceleration ratio of the output shaft of the starter. In order to increase the deceleration ratio, a deceleration mechanism has been proposed that includes additional stages or includes planetary gears that have an increased diameter.

Nevertheless, there is a problem in that the starter is increased in size in both the axial and radial directions when the number of deceleration mechanism stages is increased. On the other hand, when a diameter of the planetary gear—for example, a diameter of the first planetary gear—is increased, an outside diameter of the first bracket that serves as the first ring gear is also increased. A forming position of gear teeth that are formed on the first bracket thus conflicts with a integrating position of the first bracket and the casing of the motor portion. The casing of the motor portion thus must be increased in diameter so as to match the first bracket. This causes another problem in that the diameter of the starter as a whole is increased in size.

Increasing the size of the starter using the above conventional approaches for increasing deceleration ratio of the output shaft of the starter is unacceptable considering the need to downsize. The present disclosure solves the above problems as well as other problems and is also able to achieve various advantages.

The disclosure addresses an exemplary aspect of a starter that includes a motor portion that includes a motor shaft; a deceleration mechanism portion that is integrated with the motor portion, the deceleration mechanism portion includes a planetary gear that revolves around the motor shaft; and an output shaft that rotates integrally with a revolution of the planetary gear, wherein a bracket of the deceleration mechanism portion, in which a ring-shaped gear is formed at an inner circumferential surface so as to mesh with the planetary gear, is integrated with a casing of the motor portion by an intermediate bracket.

In another exemplary aspect, the intermediate bracket is constructed so as to be integrated with the bracket of the deceleration mechanism at an outer radial side and with the casing of the motor portion at an inner radial side.

In another exemplary aspect, the deceleration mechanism is constructed with two-staged decelerating portions.

According to various exemplary aspects, while a large deceleration ratio of a starter is secured, a motor portion is not increased in size. As a result, a compact starter can be formed.

According to various exemplary aspects, a compact starter with a large deceleration ratio can be provided.

BRIEF DESCRIPTION OF THE DRAWINGS

Embodiments of the disclosure will be described with reference to the drawings, wherein.

DETAILED DESCRIPTION OF EMBODIMENTS

Figure 1:
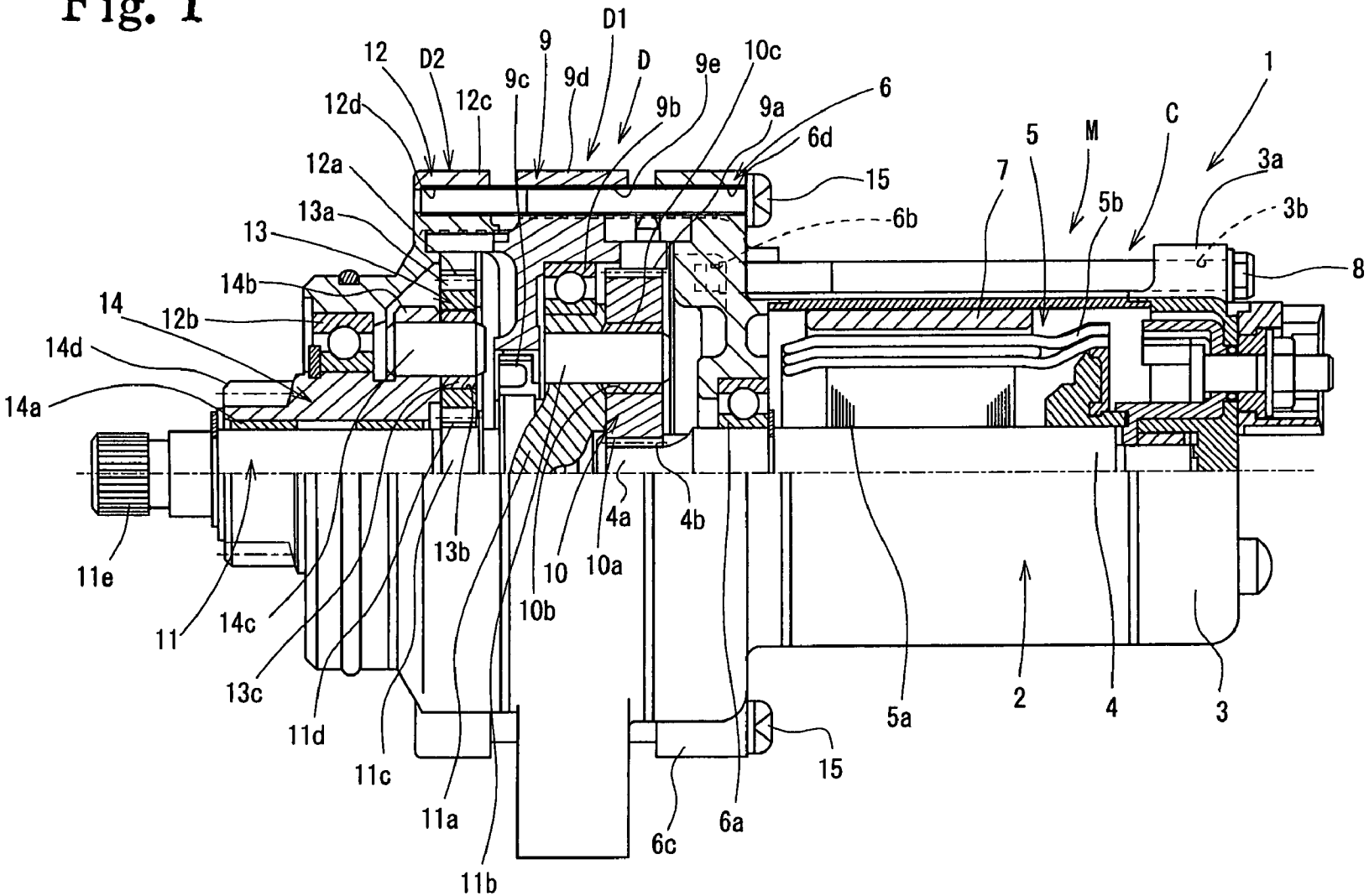
FIG. 1 is a partially sectional side view of a starter.

Next, embodiments of the present disclosure will be described based on the drawings. In FIG. 1, reference numeral 1 denotes a starter that is mounted on a two-wheeled motor vehicle. The starter 1 includes a motor portion M at a base-end side of the starter 1 and a deceleration mechanism portion D at a front-end side of the starter 1. The motor portion M includes a casing C that is constructed with a cylindrical yoke 2 and an end bracket 3 that covers a base-end portion of the yoke 2 so as to have a cylindrical shape with the bottom. The casing C is internally equipped with an armature 5 that is constructed by winding a coil 5*b* around a motor shaft 4 that is externally fitted with a plurality of core materials 5*a* in a manner prevented from rotating. A base end of the motor shaft 4 is supported so as to be freely rotatable on the end bracket 3. A front-end portion of the motor shaft 4 is supported so as to be freely rotatable via a bearing 6*a* on an intermediate bracket 6. As electricity is supplied to the coil 5*b*, the armature 5 rotates within the yoke 2 to whose inner circumferential surface a permanent magnet 7 is fixed.

Provided at each cylinder end portion of the yoke 2, the end bracket 3 and the intermediate bracket 6 are integrated via through-bolts 8, which is an example of a first fixing member (see FIG. 1). For the end bracket 3, formed are bulge-out portions 3*a* at a plurality of circumferential points (for example, three points) thereof, and screw holes 3*b* are formed in the bulge-out portions 3*a* (see FIGS. 1 and 2). In the intermediate bracket 6, formed are screw holes 6*b* that are located at a plurality of circumferential points thereof corresponding to the screw holes 3*b*. The through-bolts 8 are screwed into these screw hole 3*b* and 6*b*, respectively, so that the casing C of the motor portion M and the intermediate bracket 6 are integrated with each other.

A front end 4*a* of the motor shaft 4 passes through the intermediate bracket 6 so that the motor shaft 4 protrudes to a deceleration mechanism portion D side (see FIG. 1). For the motor shaft front end 4*a* protruding to the deceleration mechanism portion D side, a plurality of circumferential gear teeth 4*b* are formed at outer circumferential surfaces of the motor shaft front end 4*a* (see FIGS. 1 and 2). The motor shaft front end 4*a* thus functions as a first sun gear of a first deceleration mechanism D1.

Figure 2:
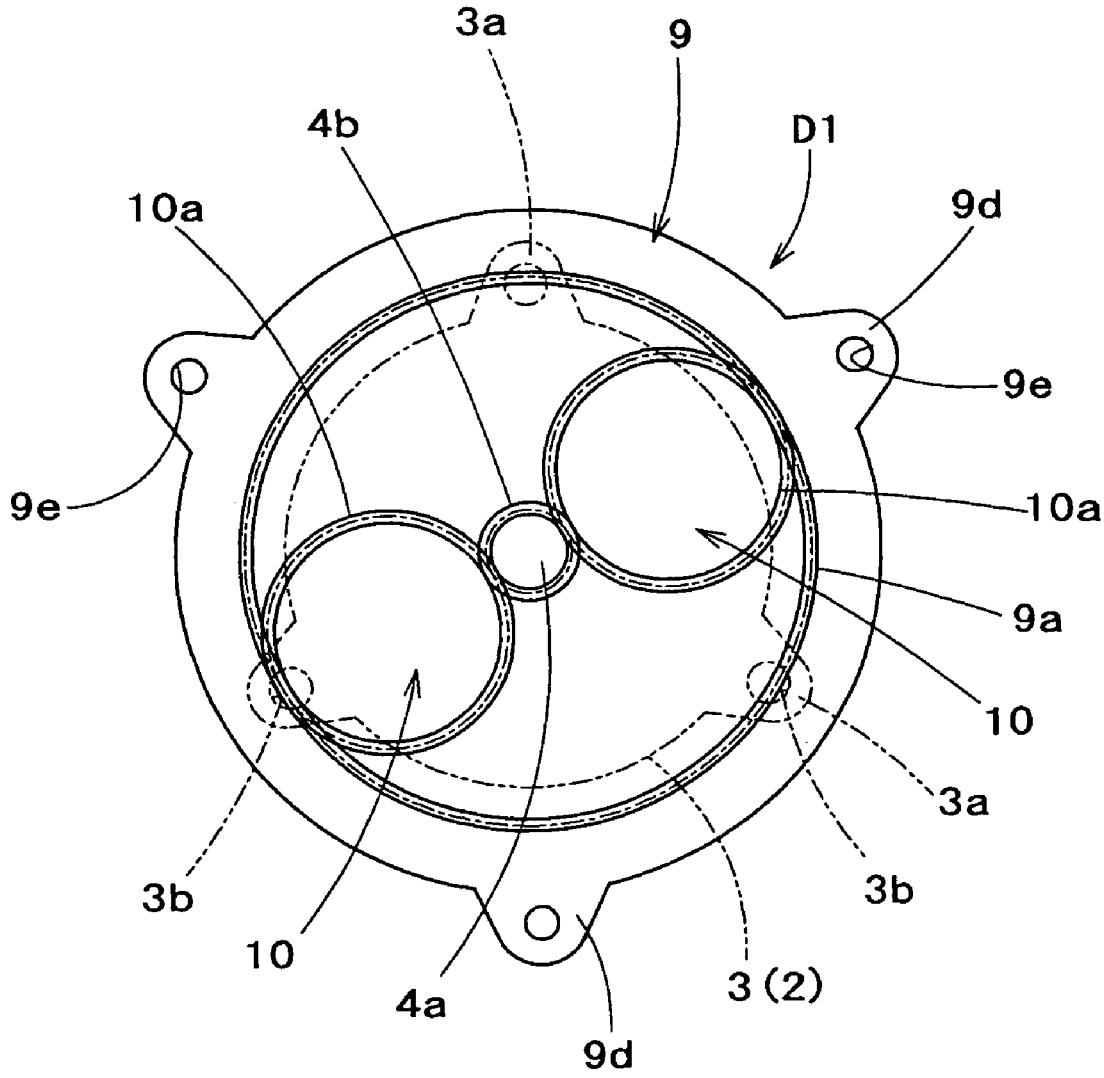
FIG. 2 is a pattern view of a cross section for explaining a first deceleration mechanism.

Reference numeral 9 denotes a ring cylinder-shaped first bracket that is provided adjacent to a front-end side of the intermediate bracket 6 and is externally fitted with the motor shaft front end 4*a* (see FIGS. 1 and 2). A plurality of circumferential gear teeth 9*a* are formed at an inner circumferential surface of the first bracket 9. The first bracket 9 thus functions as a first ring gear of the first deceleration mechanism D1.

A plurality of (in the present embodiment, two) first planetary gears 10 are disposed in a ring-shaped space that is formed between the first sun gear (motor shaft front end 4*a*) and the first ring gear (first bracket 9) (see FIGS. 1 and 2). The first planetary gears 10 are formed so as to be short cylinder-shaped rotors, and a plurality of circumferential gear teeth 10*a* are formed around the first planetary gears 10. These gear teeth 10*a* mesh with the respective gear teeth 4*b* and 9*a* of the first sun gear and the first ring gear.

Reference numeral 11 denotes a first output shaft that is concentrically positioned with respect to the motor shaft 4 and is disposed so as to extend to the front-end side of the motor shaft 4 (see FIG. 1). At a base-end portion of the first output shaft 11, integrally formed is a flange portion 11*a* that extends to an outer radial side of the first output shaft 11 in a stepped form. On the flange portion 11*a*, integrally and protrudingly formed are first spindles 11*b* that are located at three circumferential points and toward a base-end side. Via respective bearings 10*c*, the first spindles 11*b* are supported so as to be freely rotatable on through-holes 10*b* that are formed at shaft core portions of the plurality of the first planetary gears 10. When the motor portion M is driven to rotate the motor shaft 4 and the first planetary gears 10 rotates around the motor shaft 4 (first sun gear), then the first output shaft 11 rotates in a decelerated state by one stage. This construction thus serves as a first deceleration mechanism D1.

Reference numeral 9*b* denotes a bearing member that is provided on a cylinder inner surface of the first bracket 9 for freely rotatably supporting the first output shaft flange portion 11*a* (see FIG. 1). Reference numeral 9*c* denotes an oil seal.

At a front-end side of the first bracket 9, adjacently disposed is a second bracket 12 that is formed in a ring cylinder shape and is disposed so as to externally fit with a front-end side portion 11*c* further than the flange portion 11*a* of the first output shaft 11 (see FIG. 1). A plurality of circumferential gear teeth 12*a* is formed at inner cylindrical surfaces of the second bracket 12, and thereby functions as a second ring gear of a second deceleration mechanism D2.

On the first output shaft 11, on outer circumferential surfaces of the front-end side portion 11*c* that is internally fitted with the second bracket 12, a plurality of circumferential gear teeth 11*d* are formed. The first output shaft front-end side portion 11*c* thus functions as a second sun gear.

A plurality of (in the present embodiment, two) second planetary gears 13 are disposed in a ring-shaped space that is formed between the second sun gear (front-end side portion 11*c*) and the second ring gear (second bracket 12) (see FIG. 1). The second planetary gears 13 are constructed in the same manner as the first planetary gears 10 and are set such that a plurality of circumferential gear teeth 13*a* thereof mesh with the respective gear teeth 11*d* and 12*a* of the second sun gear and the second ring gear.

Reference numeral 14 denotes a second output shaft that is concentrically positioned with respect to the motor shaft 4 and the first output shaft 11 and is externally fitted around the first output shaft 11 via a bearing 14*a* so as to be freely rotatable. At a base-end portion of the second output shaft 14, integrally formed is a flange portion 14*b* that extends to an outer radial side. On the flange portion 14*b*, integrally and protrudingly formed are second spindles 14*c* that are located at two circumferential points and faces toward a base-end side. Via respective bearings 13*c*, the second spindles 14*c* are supported so as to be freely rotatable on through-holes 13*b* that are formed at shaft core portions of the plurality of the second planetary gears 13.

Accordingly, when the motor portion M is driven to rotate the motor shaft 4 and the first planetary gears 10 rotates around the motor shaft 4 (first sun gear 4*a*), the first output shaft 11 rotates in a decelerated state by one stage. Then the second planetary gears 13 rotates around the first output shaft 11 (front-end side portion 11*c*), and the second output shaft 14 rotates in a decelerated state by two stages. This construction thus serves as the second deceleration mechanism D2.

Here, of the first and second planetary gears 10 and 13 of the present embodiment, because an outside diameter of the first planetary gears 10 is set greater than the conventionally set diameter, the first and second output shafts 11 and 14 are both increased in deceleration ratio.

Reference numeral 12*b* denotes a bearing member that is provided on a cylinder inner surface of the second bracket 12 for freely rotatably supporting a front-end portion of the second output shaft 14 (see FIG. 1).

In the present embodiment, the first output shaft 11 is disposed so as to protrude to the front-end side of the second output shaft 14 (see FIG. 1). It is constructed such that power that is decelerated by different numbers of stages can be taken out from both the first and second output shafts 11 and 14. Gear teeth 11*e* that are formed at the front end of the first output shaft 11 are meshed with a gear (not illustrated) on the engine side so that an engine can start as the first output shaft 11 rotates. In addition, if gear teeth 14*d* that are formed at the front end of the second output shaft 14 are connected to, for example, a reverse gear, then the motor portion M of the starter 1 can also be used as a reversing drive member.

In the starter 1 constructed as such, while being integrally fixed to the intermediate bracket 6, the first bracket 9 and the second bracket 12 are set to have the same outside diameter. The first bracket 9 and the second bracket 12 thus have inside diameters that can be corresponded to the outside diameters of the first planetary gears 10 and the second planetary gears 13, and an outside diameter larger than that of the end bracket 3 (yoke 2) of the motor portion M.

The intermediate bracket 6 is formed with an outside diameter almost the same as that of the first bracket 9 and the second bracket 12. Around the intermediate bracket 6 and the first and second brackets 9 and 12, formed are bulge-out portions 6*c*, 9*d*, and 12*c* that bulges out in an outer radial direction so as to be located at a plurality of circumferential points (for example, three points) and long in the axial direction, respectively (see FIG. 1). In these bulge-out portions 6*c*, 9*d*, and 12*c*, communicatingly formed are screw holes 6*d*, 9*e*, and 12*d*, respectively. Furthermore in the present embodiment, forming positions of these screw holes 6*d*, 9*e*, and 12*d* are parts being on an outer radial side further than the outer radial position of the end bracket 3. By inserting through-bolts 15, which is an example of a second fixing member, from the intermediate bracket 6 side and screwing the through-bolts 15 into these screw holes 6*d*, 9*e*, and 12*d*, the first and second brackets 9 and 12 are integrated with the intermediate bracket 6.

The intermediate bracket 6 is provided between the motor portion M and the deceleration mechanism portion D so that a fixing portion of the casing C with respect to the intermediate bracket 6 and fixing portions of the first and second brackets 9 and 12 of the deceleration mechanism portion D are displaced in a radial direction. Accordingly, there is no such case, as in the conventional art, where a casing of a motor portion and a first bracket are directly integrated, and that a gear teeth forming position of the first bracket interferes with a integrating position of the first bracket and the motor portion due to an increased diameter of the first bracket. An outside diameter of the motor portion M does not need to be the same as an outside diameter of the deceleration mechanism portion D, and thereby can be kept small. As a result, even if an outside diameter of the deceleration mechanism portion D is increased in order to secure a large deceleration ratio, the motor portion M remains small in diameter, and the starter 1 as a whole is not increased in size. For the space where the starter 1 is disposed, the degree of freedom of design thus can be improved.

In the present embodiment constructed as described, the starter 1 is constructed with the motor portion M and the deceleration mechanism portion D. An outside diameter size of the first planetary gear 10 is set large so as to secure a large deceleration ratio. While the outside diameter of the first ring gear (first bracket 9) of the first deceleration mechanism D1 is larger, the first bracket 9 and the casing C of the motor portion M are not directly integrated and are instead integrated via the intermediate bracket 6. As a result, the size of outside diameter of the first bracket 9 and the casing C of the motor portion M does not need to be matched. A large deceleration ratio of the starter 1 thus can be secured without the starter 1 in itself being increased in size. Therefore, the starter 1 with higher degrees of freedom in design can be provided.

The starter 1 can be provided for which a large deceleration ratio is secured by increasing the outside diameter size of the first planetary gear 10 without changing the diameter of the motor portion M. Furthermore, since the first and second deceleration mechanisms D1 and D2 are provided, a starter 1 can be compactly formed with a even larger deceleration ratio.

The present disclosure is, as a matter of course, not limited to the aforementioned embodiment. In recent years, motor portions have been reduced in size. When a starter is constructed with a motor portion that is reduced in size, by using an intermediate bracket of the present disclosure, regardless of a shape of a deceleration mechanism portion, the starter can be provided in a state where advantages of the motor portion that is reduced in size are not impaired and are sufficiently displayed. Furthermore, changing the intermediate bracket in shape heightens the degree of freedom in a combination between the motor portion and deceleration mechanism portion.

What is claimed is:

1. A starter, comprising:

a motor portion that includes a motor shaft with a sun gear on a front side of the motor shaft; and a deceleration mechanism portion that includes:

a planetary gear that meshes with the sun gear to revolve around the sun gear; and an output shaft that rotates integrally with the planetary gear, wherein:

the motor portion includes an intermediate bracket that supports a front-end portion of the motor shaft, to which the sun gear is formed, such that the front-end portion is freely rotatable, with the sun gear protruding toward the front side of the motor shaft, and further the sun gear being positioned at the front side of the motor shaft in an axial direction relative to the intermediate bracket, the deceleration mechanism portion includes a first deceleration mechanism that decelerates an output of the sun gear so as to output to an engine side; and a second deceleration mechanism that decelerates an output of the first deceleration mechanism so as to output to a reverse gear, a first bracket of the first deceleration mechanism, in which a ring-shaped gear is formed at an inner circumferential surface of the first bracket so as to mesh with the planetary gear, is arranged adjacent to the front side of the motor shaft in the axial direction relative to the intermediate bracket, the intermediate bracket is integrated with a casing of the motor portion at an inner radial side via a first through-bolt and with the first bracket at an outer radial side via a second through-bolt, the first deceleration mechanism is arranged adjacent to a front side with respect to the intermediate bracket and the second deceleration mechanism is arranged adjacent to a front side with respect to the first deceleration mechanism, the first bracket is adjacent to the front side with respect to the intermediate bracket and a second bracket of the second deceleration mechanism is adjacent to the front side with respect to the first bracket, and the first bracket and the second bracket are integrated with the intermediate bracket via the second through-bolt.

2. The starter according to claim 1, wherein a front end of the motor shaft passes through the intermediate bracket so that the motor shaft protrudes to a deceleration mechanism portion side of the intermediate bracket.

3. The starter according to claim 2, wherein the front end of the motor shaft meshes with the planetary gear.

4. The starter according to claim 1, wherein an outside diameter of the intermediate bracket is approximately equal to an outside diameter of the first bracket.

5. The starter according to claim 1, wherein an outside diameter of the first bracket is greater than an outside diameter of the casing of the motor portion.

* * * * *